US007597145B2

(12) United States Patent
Allard et al.

(10) Patent No.: US 7,597,145 B2
(45) Date of Patent: Oct. 6, 2009

(54) FLUID-FLOW SYSTEM, DEVICE AND METHOD

(75) Inventors: Philip Allard, San Angelo, TX (US); Stanley D. Benham, Gardendale, TX (US)

(73) Assignee: Blue Marble Engineering, L.L.C., San Angelo, TX (US)

( * ) Notice: Subject to any disclaimer, the term of this patent is extended or adjusted under 35 U.S.C. 154(b) by 199 days.

(21) Appl. No.: 11/167,673

(22) Filed: Jun. 27, 2005

(65) Prior Publication Data

US 2006/0260807 A1 Nov. 23, 2006

Related U.S. Application Data

(60) Provisional application No. 60/682,291, filed on May 18, 2005.

(51) Int. Cl.
*E21B 43/12* (2006.01)

(52) U.S. Cl. ..... 166/267; 175/66; 366/272

(58) Field of Classification Search ..... 166/267; 175/66; 366/272
See application file for complete search history.

(56) References Cited

U.S. PATENT DOCUMENTS

| | | | |
|---|---|---|---|
| 1,348,771 | A | 8/1920 | Auger |
| 1,348,772 | A | 8/1920 | Auger |
| 1,656,093 | A | 1/1928 | Baker |
| 1,923,268 | A | 8/1933 | Jensen |
| 2,280,271 | A | 4/1942 | Sullivan |
| 2,280,272 | A | 4/1942 | Sullivan |
| 2,387,761 | A | 10/1945 | Kendrick |
| 2,765,749 | A | 10/1956 | Mosbacher |
| 3,142,476 | A | 7/1964 | Goodwin |
| 3,152,792 | A | 10/1964 | Goodwin |
| 3,179,382 | A | 4/1965 | Knedlik |
| 3,266,430 | A | 8/1966 | Mylo |
| 3,280,886 | A | 10/1966 | Marshall et al. |
| 3,420,180 | A | 1/1969 | Behrends et al. |
| 3,435,773 | A | 4/1969 | Gustafsson |
| 3,447,422 | A | 6/1969 | Bidlack et al. |
| 3,488,699 | A | 1/1970 | Lee et al. |
| 3,526,470 | A | 9/1970 | Swanson |
| 3,558,282 | A | 1/1971 | Evans |
| 3,575,535 | A | 4/1971 | Bickar |
| 3,693,653 | A | 9/1972 | Cramer et al. |
| 3,759,324 | A | 9/1973 | Mecusker |
| 3,827,240 | A | 8/1974 | Lundquist |

(Continued)

FOREIGN PATENT DOCUMENTS

DE 8912465 U 1/1990

(Continued)

OTHER PUBLICATIONS

Global-Volvo Penta: 2004-D4 and D6 commercial, http://www.volvo.com/volvopenta/global/en-gb/newsmedia/pressreleases/2004/D4_and _..., Sep. 28, 2004, XP-002402898.

(Continued)

*Primary Examiner*—Shane Bomar

(57) ABSTRACT

Methods, devices, and systems are disclosed for combining fluids of different pressures and flow rates in, for example, gas gathering systems, gas wells, and other areas in which independently powered compressors or pumps are not desired.

19 Claims, 12 Drawing Sheets

U.S. PATENT DOCUMENTS

| | | | | |
|---|---|---|---|---|
| 3,921,659 | A | 11/1975 | Rudewick, Ill | |
| 4,015,828 | A | 4/1977 | Miles | |
| 4,032,391 | A | 6/1977 | Moked et al. | |
| 4,193,745 | A * | 3/1980 | Hamilton et al. | 418/9 |
| 4,776,176 | A | 10/1988 | Vinz | |
| 4,859,158 | A * | 8/1989 | Weinbrecht | 418/9 |
| 5,012,837 | A | 5/1991 | Zepp | |
| 5,156,301 | A | 10/1992 | Hassell et al. | |
| 5,341,782 | A * | 8/1994 | McCall et al. | 123/246 |
| 5,558,116 | A | 9/1996 | Dubach | |
| 5,588,088 | A | 12/1996 | Flaman | |
| 5,725,362 | A | 3/1998 | Zepp et al. | |
| 5,730,589 | A | 3/1998 | Rausch et al. | |
| RE35,780 | E | 5/1998 | Hassell | |
| 5,792,271 | A | 8/1998 | Fujikawa et al. | |
| 6,182,682 | B1 | 2/2001 | Chen | |
| 6,209,564 | B1 | 4/2001 | Chang | |
| 6,238,178 | B1 | 5/2001 | Stearne | |
| 6,283,459 | B1 | 9/2001 | Kojima | |
| 6,299,672 | B1 | 10/2001 | Rivas | |
| 6,345,954 | B1 | 2/2002 | Al-Himyary et al. | |
| 6,769,449 | B2 | 8/2004 | Stearns | |
| 6,824,368 | B2 | 11/2004 | Luigi | |
| 7,150,611 | B2 * | 12/2006 | Perna | 418/201.1 |
| 2002/0129938 | A1 | 9/2002 | West et al. | |
| 2002/0166586 | A1 | 11/2002 | Flavelle | |
| 2003/0086331 | A1 | 5/2003 | Lin | |
| 2004/0228752 | A1 | 11/2004 | Peters et al. | |
| 2007/0277967 | A1 | 12/2007 | Oserod | |

FOREIGN PATENT DOCUMENTS

| | | | |
|---|---|---|---|
| GB | 1414430 | A | 11/1975 |
| GB | 2161860 | A | 1/1986 |
| JP | 53024608 | | 3/1978 |
| JP | 53024608 | A | 3/1978 |
| JP | 53049308 | A | 5/1978 |
| JP | 6477778 | | 3/1989 |
| JP | 03088989 | | 4/1991 |
| WO | WO 85/04215 | | 9/1985 |

OTHER PUBLICATIONS

Jeff Beale, Non-Traditional Sources and Uses of LNG, Dec. 15, 2005, pp. 1-8.

Cryostar Turbine Data Sheet, Dec. 15, 2005, pp. 1-5.

Mafi-Trench Corporation Customer Testimonials, Dec. 15, 2005, pp. 1-9.

[Gasification] Turbo expander lies, was Doug, William, and listers, Dec. 15, 2005, pp. 1-18.

Global-Volvo Penta: 2004-D4 and D6 commercial, http://www.volvo.com/volvopenta/global/en-gb/newsmedia/pressreleases/2004/D4_and_ . . . , Sep. 28, 2004, XP-002402898.

International Search Report for International Application No. PCT/US2006/019000.

* cited by examiner

FLUID-FLOW SYSTEM, DEVICE AND METHOD

RELATED APPLICATION DATA

The instant application claims priority to prior provisional application no. 60/682,291, filed May 18, 2005.

BACKGROUND

In many areas involving fluid-flow, it is desirable to combine two streams of fluid that have different pressures. An example of such a system is a well that produces natural gas.

The gas that comes from a flowing well is typically passed through a separator where liquids "drop out" of the gas stream. Those liquids are very valuable; they contain a high BTU content. The liquids are removed from the separator and placed in a large liquid storage tank, and the remaining gas is removed from the separator in a gas line. The liquid storage tank generates vapor that is slightly above atmospheric pressure. That vapor must be compressed to a pressure closer to the gas leaving the separator (which is expensive) or that vapor must be vented to the atmosphere. In some cases, the volume of vapor is sufficient that a flare can be used; however, flaring of the vapor usually results in incomplete combustion and undesirable by-products, and that results in pollution. It is also a waste of the energy content of the vapor.

Therefore, there is a need for a method, system, and device, which can take fluid of a first pressure (for example, high pressure gas coming from a separator) and combine into that first-pressure-fluid a second fluid of lower pressure (for example, the vapor from a liquid storage tank) while avoiding the normal costs of compression of the second, lower pressure gas.

In some other examples, there are multiple wells in an oil and/or gas producing field. Those wells may be producing gas at differing pressures. To put those multiple wells (each producing at a different pressure) on an individual gas transmission line requires pressure release from the higher pressure flows or compression of the lower line pressure flows. Again, the cost of compression is high; either an electric or gas-fired engine driven compressor is needed. Whether the cost is in lost gas, the cost of electricity, or the cost of the fuel needed to run the compressor, it is undesirable. Therefore, there is a need to combine flows of fluids having different pressures into an individual fluid flow line without the traditional compression or pumping steps.

SUMMARY

According to a first example of the invention, a gas gathering system is provided comprising: a first well; a first flow line of gas from the first well; a first separator connected to the first flow line; a first separated gas flow line connected to a first input of a means for combining at least two gas flows having different pressures; a second well; a second flow line of gas from the second well; a second separation connected to the second flow line; a second separated gas flow line connected to a second input of the means for combining; wherein the means for combining comprises a first input volume and a second input volume; and a pressure differential between the first input volume and the second input volume causes a portion of the first input volume to be combined with a portion of the second input volume at an output volume.

In another example of the invention, a gas gathering system is provided that comprises: a first input of gas at a first pressure; a second input of gas at a second pressure, the first pressure being higher than the second pressure; a means for combining the first and the second inputs of gas; wherein the means for combining uses pressure differences between the first input of gas and the second input of gas to power the means for combining. At least one such system further comprises a gas/fluid separator receiving gas and fluids from a well; wherein the first input of gas comprises gas from the separator, and a liquids tank, receiving liquids from the separator, and wherein the second input of gas comprises vapor from the tank.

In still another example of the invention, an apparatus is provided that is useful in combining at least two fluids of differing pressures. The apparatus comprising: a housing; a first rotor within the housing; a second rotor within the housing, the first rotor engaging the second rotor and both the first and the second rotors engaging the housing; a third rotor within the housing and engaging the first rotor; a fourth rotor within the housing and engaging the second rotor, the third rotor engaging with the fourth rotor and both the third and the fourth rotors engaging the housing; wherein the first and the second rotors define a first input volume; wherein the third and the fourth rotors define a second input volume; wherein the first and the third rotors define a first output volume; and wherein the second and the fourth rotors define a second output volume.

In at least some such examples, at least two rotors engage each other in a sealing arrangement and are substantially the same size. In other examples, a first pair of the rotors is larger than a second pair of the rotors. In many examples, the rotors are mounted on bearings around fixed shafts; while, in further examples, at least one rotor is fixed to the shaft of the rotor.

In some examples, the housing comprises a substantially cylindrical shape and has sealing surfaces that are arranged to seal with the rotors. Inputs are also substantially normal to the axis of the housing. In further examples, the housing comprises inputs substantially parallel to the axis of the housing.

In yet another example of the invention, a rotor is provided that is useful in an apparatus for combining at least two fluids of differing pressures. The rotor comprises: a set of protrusions; a set of recesses between the protrusions; wherein the protrusions comprise sealing surfaces, at least a portion of the sealing surface comprises a portion of a first circle, the recesses comprise sealing surfaces, at least a portion of the sealing surface comprises a portion of a second circle, the first circle and the second circle are tangential, the first circle and the second circle each have centers located on a circle having a center on an axis of the rotor. Some such rotors form a substantially cylindrical void in their center and rotate on bearings about a shaft. Other such rotors are fixed to a shaft, and the shaft rotates.

DETAILED DESCRIPTION OF EXAMPLE EMBODIMENTS OF THE INVENTION

Figure 1A:
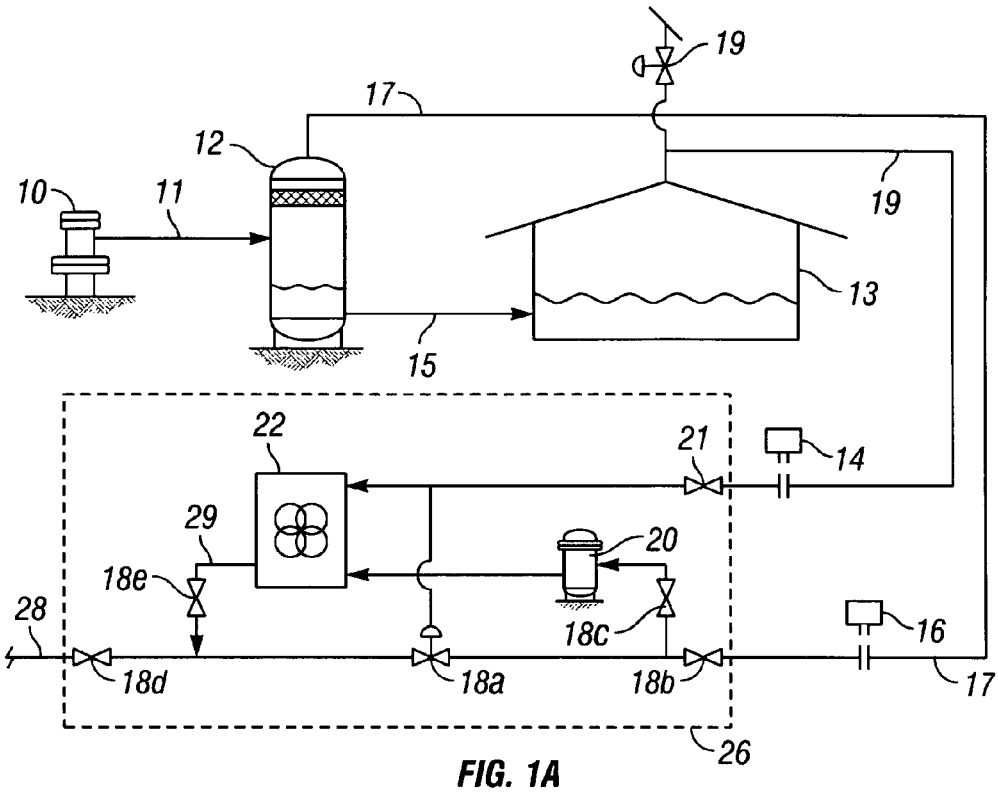
FIGS. 1A-1D are a schematic of an example of the invention.

FIG. 1A illustrates an example of the invention in which a flowing well 10 sends gas to separator 12 over flow-line 11. From separator 12 (of a common design known to those of skill in the art), liquids pass through liquid transfer line 15 into storage tank 13. Gas passes from separator 12 onto gas flow line 17. Vapor from liquid storage tank 13 is removed from liquid storage tank 13 via vapor flow line 19. The pressure and gas flow line 17 is higher than the pressure in vapor flow line 19. Therefore, combiner unit 26 is provided to combine the fluid flow from gas flow line 17 and vapor flow line 19 into a single combined gas flow line 28.

Vapor flow line 19 is passed through vapor flow meter 14 and enters combiner unit 26 at valve 21. Gas flow line 17 is passed through gas flow meter 16 and enters combiner unit 26 at valve 18*b*. Valve 18*a* opens and closes in response to a pressure transmitter located in line 19 (not shown), thereby controlling whether the higher pressure gas passes directly through combiner unit 26 to gas flow line 28 or whether it will be combined with vapor from vapor flow line 19. Valves 18*a*, 18*b*, 18*c*, 18*d*, 18*e*, and 21 comprise manually operated valves (in some examples), which remain in an open position until it is necessary to perform maintenance or repairs; then, they are closed to isolate unit 26. For example, if valve 18*a* is closed, and valves 18*b* and 18*c* are open, gas flows from gas flow line 17 through solids filter 20 and into combiner component 22 (also sometimes referred to herein as a means for combining). When valve 21 is open, vapor flowing at a low pressure from vapor flow line 19 also enters combiner component 22. In some other examples, one or more of valves 18*a*-18*e* or 21 comprise automated-operation valves.

Combiner component 22 combines the gas flow and vapor flow, resulting in an individual flow that is at a pressure between the pressure of the gas and the vapor, and that individual flow is passed through valve 18*e* onto combined gas flow line 28 by the opening of valve 18*d* with valve 18*a* closed.

In at least some alternative embodiments, filter 20 is not used. Likewise, in some alternative embodiments, vapor flow meter 14 and/or gas flow meter 16 are not used. A pressure release valve 19 is seen connected to liquid storage tank 13 for the purpose of venting excess pressure build-up in liquid storage tank 13 either to air, a traditional compressor, or a flare (in the event of a problem downstream of liquid storage tank 13).

Figure 1B:
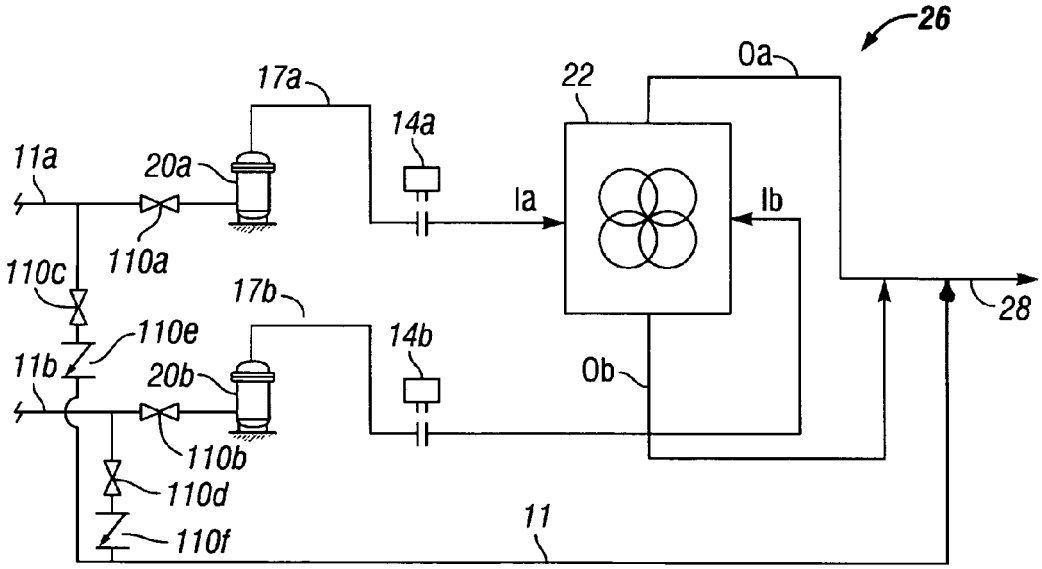

Referring now to FIG. 1B, another example embodiment of a combiner unit 26 is seen in which at least two flow lines 11*a* and 11*b* from independent wells (not shown) feed into solids filters 20*a* and 20*b* through valves 110*a* and 110*b*. Valves 110*c* and 110*d* allow communication between flow lines 11*a* and 11*b* in an open state and isolates flow lines 11*a* and 11*b* in a closed state. Check valves 110*e* and 110*f* prevent back flow.

Gas flow lines 17*a* and 17*b* are fed through flow meters 14*a* and 14*b* respectively into inputs Ia and Ib of combiner component 22. Gas from different wells may flow at different pressures and/or flow rates, and the flow from any particular well may fluctuate greatly. For example, wells having pumping mechanisms and/or having pressure-sensitive valves that open upon the well pressure reaching a particular level allow flow until the well pressure drops below a different level; they then close the well again, allowing pressure to build. Because of this, without a combiner component 22, it is difficult and costly to take the production of multiple wells and combine them into a single line 28. Furthermore, the production from the lesser wells is limited beyond its otherwise producing capability by the production from the greater wells; and, further still, the pressure the artificial lift mechanism must overcome is higher. Combiner component 22 takes the flows at inputs Ia and Ib and combines them into a plurality of outputs to form flow line 28. In the illustrated example, two outputs, Oa and Ob, are substantially the same pressure and flow rate at a given moment in time and are connected together (e.g., by a joint, manifold, or other form of or means for combining substantially similar flows).

Valves 110*a*, 110*b*, and 110*c*, allow a bypass of filters 20*a* and 20*b* and of combiner component 22, when valves 110*a* and 110*b* are in a closed state and valve 110*c* is in an open state. In such a case, the higher pressure and flow rate line 11*a* or 11*b* will dominate the flow into flow line 11 and then into flow line 28. In those systems in which the flow rates and pressures of the wells fluctuate, the flow line that dominates will fluctuate between line 11*a* and 11*b*. However, such an arrangement allows for maintenance of the filters 20*a* and 20*b* and of combiner component 22.

Figure 1C:
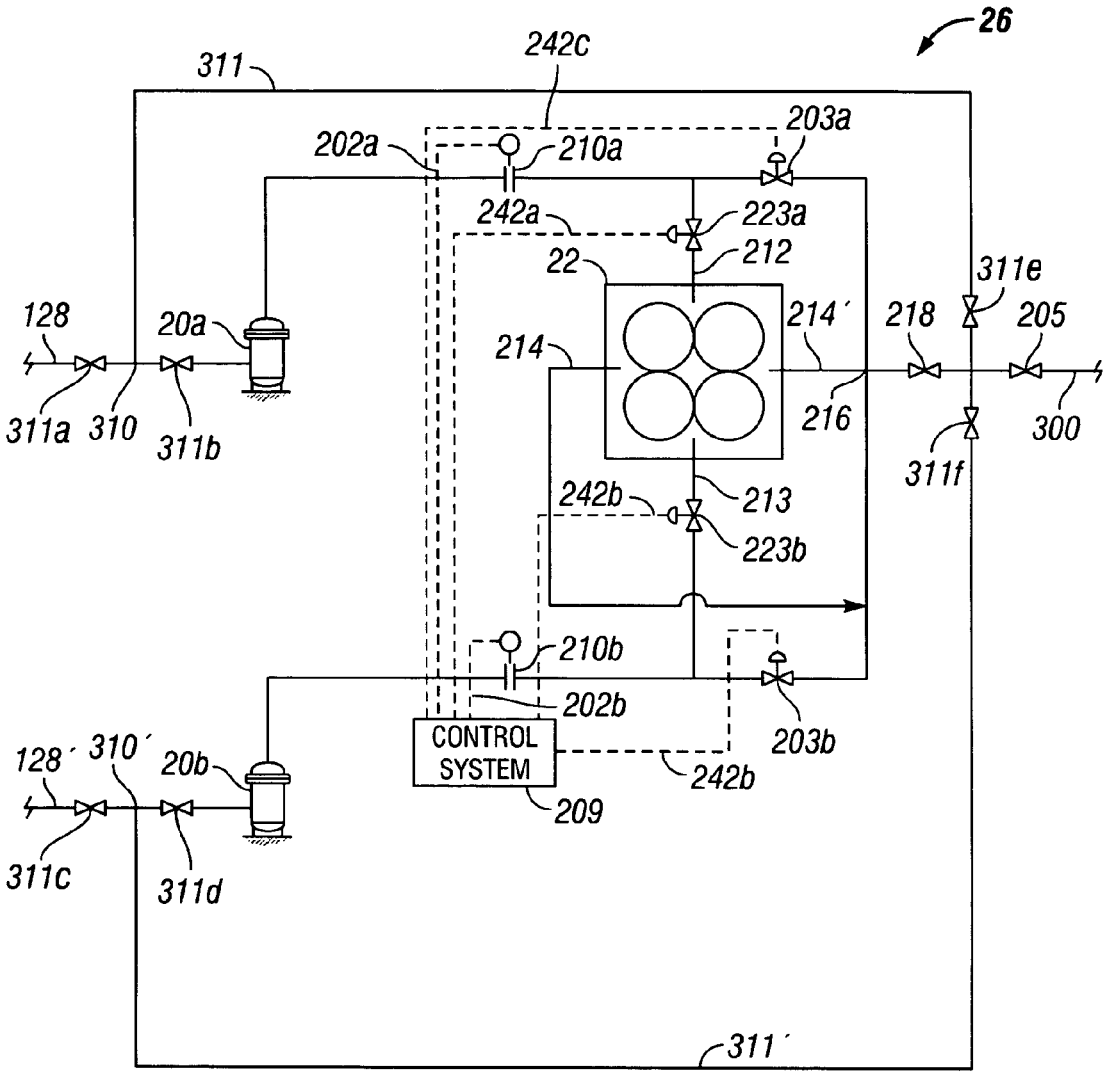

FIG. 1C illustrates a further example embodiment of a combiner unit 26 in which flow line 128 feeds into solids filter 20*a* through valves 311*a* and 311*b*, and flow line 128' feeds into solids filter 20*b* through valves 311*c* and 311*d*. When valve 311 a is in a closed state, there is no flow from line 128. When valve 311*a* is in an open state, flow occurs through bypass line 311, if valve 311*e* is in an open state and valve 311*b* is in a closed state, through T-joint 310. There is no flow in bypass line 311 when valve 311*e* is in a closed state and valve 311*b* is in an open state, and flow then continues into solids filter 20*a*. Similarly, flow line 128' is fed into solids filter 20*b* when valves 311*c* and 311*d* are in open states while valve 311*f* is in a closed state, and flow line 128' bypasses filter 20*b* through T-joint 310' when valve 311*d* is in a closed state and valve 311*f* is in an open state. Valve 218 is closed in the bypass state of the system.

Control system 209 monitors meters 210*a* and 210*b* through signal paths 202*a* and 202*b*. In the illustrated example, meters 210*a* and 210*b* comprise differential pressure meters. Other examples utilize other means for measuring pressure that will occur to those of skill in the art. Control system 209, through signal paths 242*a* and 242*b*, operates control valves 223*a* and 223*b* (based on inputs from meters 210*a* and 210*b*, respectively), to control input to combiner component 22. In conjunction with valves 203*a* and 203*b*, which are also controlled from control system 209 (through signal paths 243*c* and 243*d*), valves 223*a* and 223*b* bypass combiner component 22 under the following conditions (among others): (i) when both inlet streams 128 and 128' have pressure sufficient to enter line 300 without negative effect on production sources, (ii) line 128 or 128' does not flow, or (iii) during periods of routine maintenance or repair.

In other situations, the flow from filter 20*a* enters an input of combiner component 22 and the flow from filter 20*b* enters another input of combiner component 22. As previously mentioned, their pressures and flow rates are combined into a single flow line 300 through outputs tied to lines 214 and 214', through joint 216 (here, a cross), valves 218, and shut off valve 205.

Figure 1D:
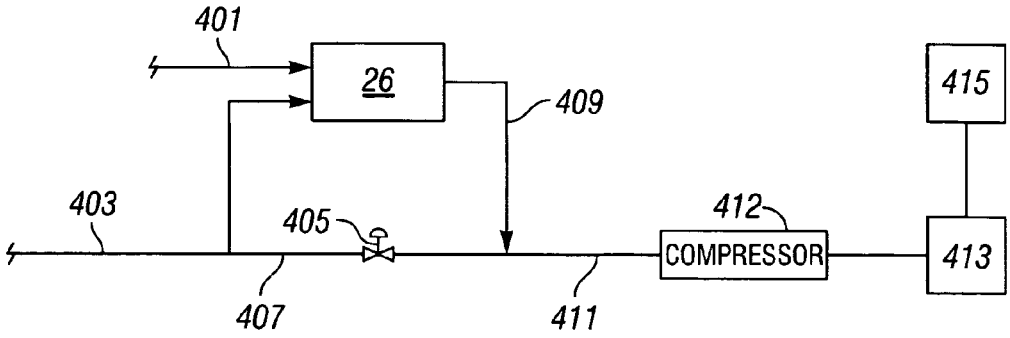

Referring now to FIG. 1D, a further alternative is seen in which a gas flow line 401 (e.g., of an individual well at 25 psi) and a second gas flow line 403 (for example, a gas gathering system trunk line at 500 psi) are input into combiner unit 26 (e.g., as seen in FIGS. 1A, 1B, and/or 1C), when valve 405 is in a closed state. The combiner unit 26 (also referred to as a means for merge unit and/or a means for gas boosting) combines the pressures and flow rates of the flow lines 401 and 403 into flow line 409 (resulting in a combined pressure between 500 psi and 25 psi) which is then fed as an input to compressor 412. Compressor 412 steps up the pressure in flow line 411 to a higher pressure (for example, main line pressure).

In many situations, the higher pressure and volume of the main line are enough that the compressor 412 is unneeded. In such a situation, output 411 becomes an input to a system of the same basic layout as seen in FIG. 1D. The main line is line 403 and the gathering system output is line 401. In some such examples, the pressure and flow rate of lines 401 and 403 will be such that there will be a negligible drop in pressure between lines 403 and 411 while still combining the volume of line 401 into compressor 412, which compresses the pressure to be used by other downstream systems 413 and/or 415.

Figure 2:
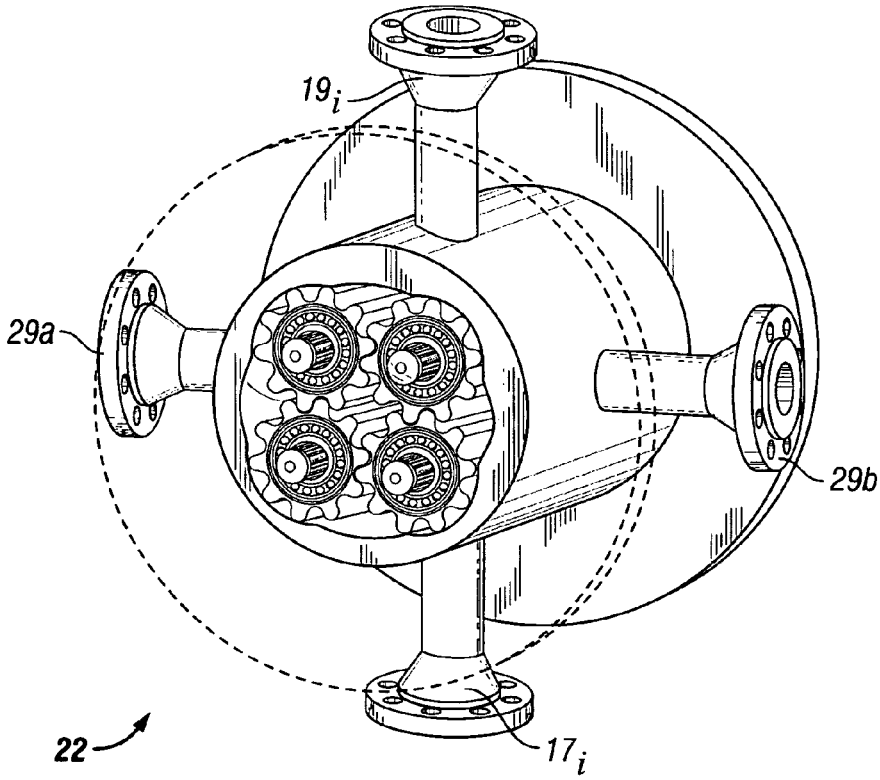
FIG. 2 is a perspective view of an example of the invention.

Referring now to FIG. 2, an example of combiner component 22 (also sometimes referred to as a means of combining) of FIGS. 1A-1D is seen. For example, gas flow line 17 (FIG. 1A) is connected to bottom input 17*i* and vapor flow line 19 (FIG. 1A) is connected to top input 19*i*. The two fluid flows from gas flow line 17 and vapor flow line 19 are combined in combiner component 22 (as will be explained in more detail below) and output through outlets 29*a* and 29*b*. The flow from outlet 29*a* is at substantially the same pressure and rate as in outlet 29*b* and the two are combined (for example, through a direct connection such as a joint or manifold) and then applied (in the example of FIG. 1A) through outlet line 29 and control valve 18*e* to combined gas flow line 28.

Figure 3:
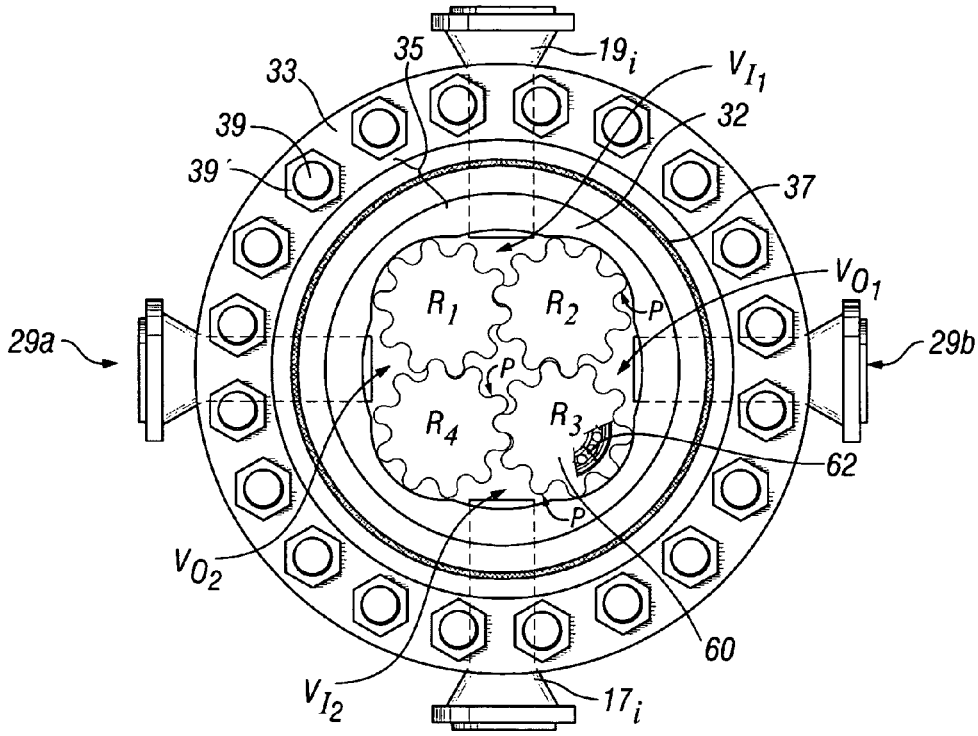
FIG. 3 is a side view of an example of the invention.

In FIG. 3, an end-view of the example combiner component 22 of FIG. 2 is seen in which vapor from vapor line 19 enters through top inlet 19*i* to form inlet volume $VI_1$ (defined between rotors R1 and R2 and inner housing pipe 32). Gas flows from flow line 17 through bottom inlet 17*i* into the second inlet volume $VI_2$ (defined between rotors R4 and R3 and inner housing pipe 32).

In operation, the high pressure in inlet volume $VI_2$ causes rotor R4 to rotate clockwise while rotor R3 rotates counter-clockwise. Likewise, rotor R1 rotates counter-clockwise while rotor R2 rotates clockwise. Rotor protrusions P seal against inner housing pipe 32 as they rotate and again seal as they mesh with their neighboring rotors. Therefore, fluid in inlet volumes $VI_1$ and $VI_2$ are passed between protrusions P and inner pipe housing 32 into outlet volumes $VO_1$ and $VO_2$. When those fluid flows reach outlet volumes $VO_1$ and $VO_2$, they combine. In both outlet volumes $VO_1$ and $VO_2$, the pressure level is between the pressure level in inlet volumes $VI_1$ and $VI_2$. Further, the pressure in $VO_1$ is about the same as the pressure in $VO_2$, and the flow in outlet volume $VO_1$ is equal to the flow in outlet volume $VO_2$. Therefore, outlets 29*a* and 29*b* can be directly combined (for example, through a simple joint or manifold).

Figure 4:
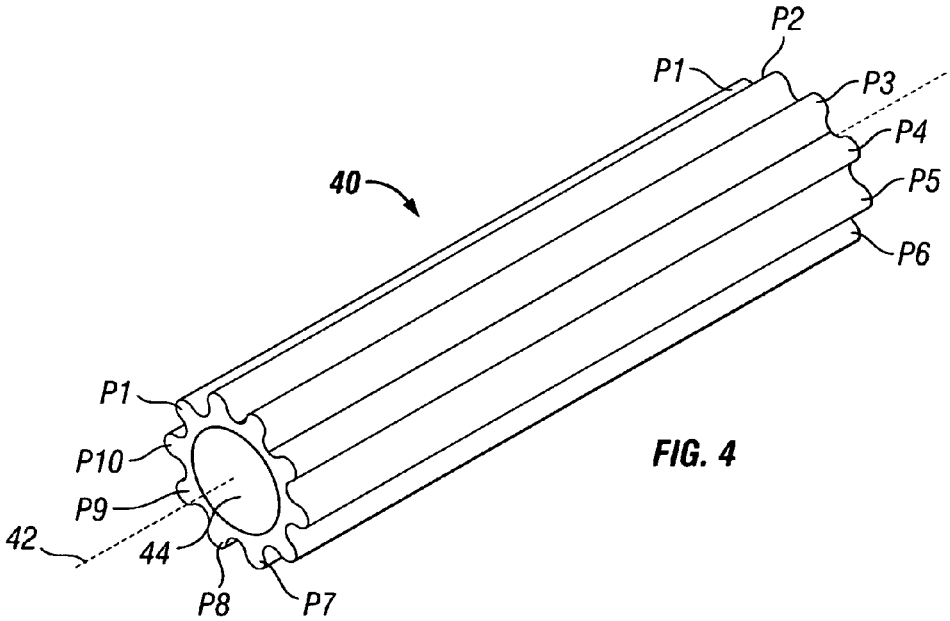
FIG. 4 is a perspective view of an example of the invention.

Referring now to FIG. 4, a perspective view of an example is seen of a rotor 40, which is useful in the example of FIG. 3 for rotors R1, R2, R3, and R4. Rotor 40 comprises a member having substantial symmetry about an axis 42 having ten protrusions P1-P10. Rotor 40 also includes a cylindrical void 44. In at least some examples, rotor 40 comprises steel, ceramic, and/or other materials that will occur to those of skill in the art.

In some examples, the outer diameter shape of rotor 40 is formed by an EDM machine. As used herein, EDM stands for electrical discharge machining, a process that is known to those of skill in the art. In some examples, the cylindrical void 44 is also formed by an EDM process. In other examples, cylindrical void 40 is bored and the outer shape is cut by an EDM process. Still other examples of methods of forming rotors include CNC (Computer Numerical Control) machining, extrusion, and other methods that will occur to those of skill in the art.

While the example of FIGS. 3 and 4 shows rotors with ten protrusions, the invention is not limited to such an example. Other numbers of protrusions are useful according to other examples of the invention, as will be explained in more detail below.

Figure 5:
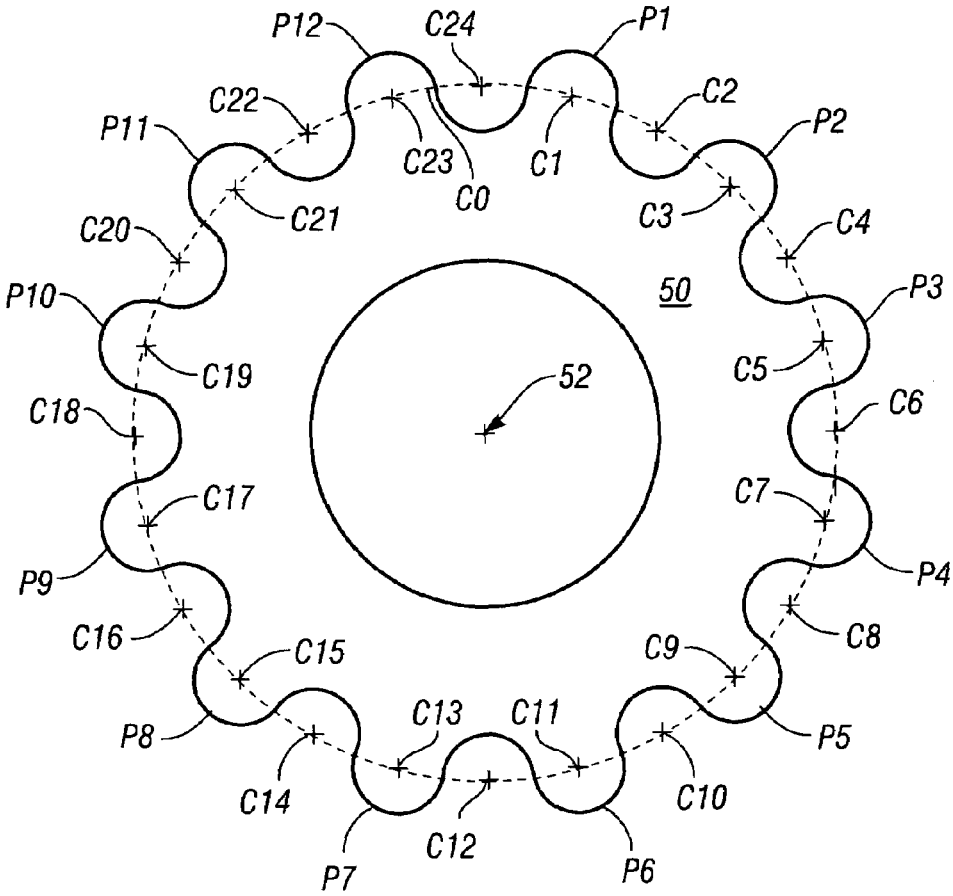
FIG. 5 is a side view of an example of the invention.
Figure 6A:
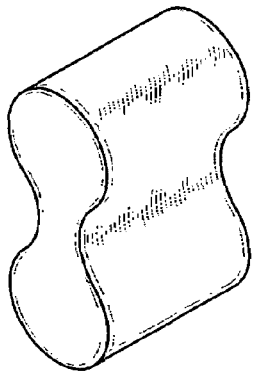
FIGS. 6A-6H are perspective views of examples of the invention.
Figure 6B:
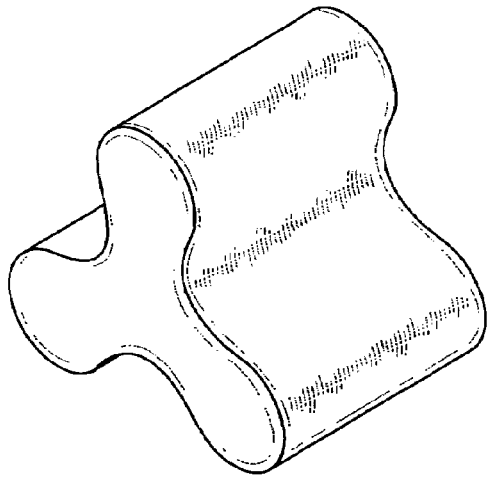
Figure 6C:
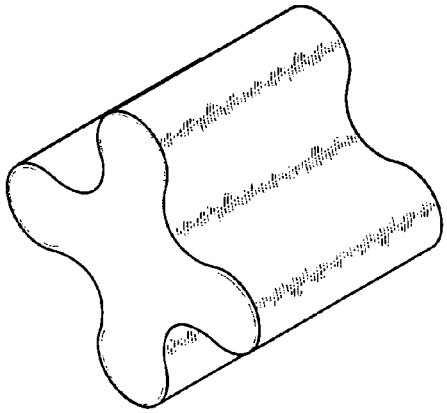
Figure 6D:
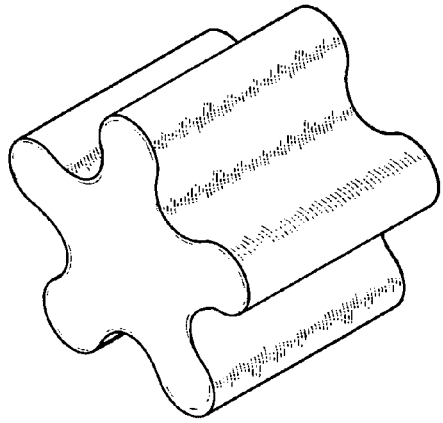
Figure 6E:
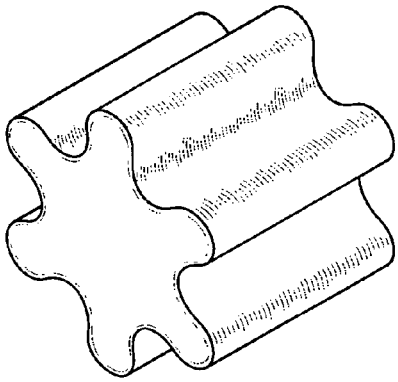
Figure 6F:
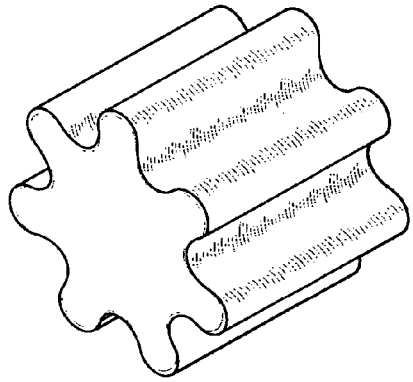
Figure 6G:
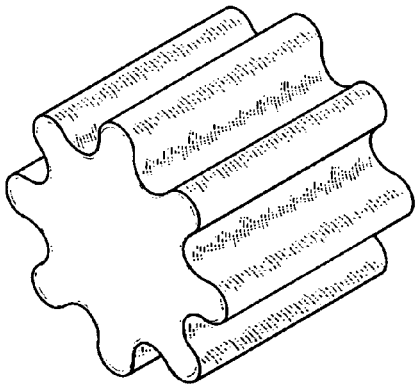
Figure 6H:
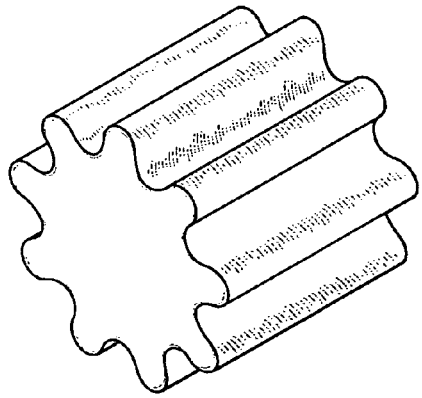

Referring to FIG. 5, a cross-sectional view of an example rotor 50 is seen having twelve protrusions P1-P12. Each of protrusions P1-P12 is formed according to a set of circles, each of which has its center C1-C24 located on a larger circle C0. C0 has its center on axis 52 of rotor 50.

Referring again to FIG. 3, as the rotors R rotate, the protrusions P seal with the recess between protrusions in adjacent rotors. In example embodiments in which the relationship of the number of protrusions to the diameter of circle C0 is maintained, the protrusions P engage in a substantially non-sliding manner when two rotors are rotated in connection with each other. Lack of a sliding engagement provides the following benefits: lack of friction, extrusion of the material in the volume (rather than compression), and reduced wear. While, in some other examples, non-circular shapes may be used, curved shapes (and, in particular, a circular shape) provide advantages of sealing the outer volumes $VI_1$, $VI_2$, $VO_1$, and $VO_2$, from each other and from the interior volume defined by the four rotors R1, R2, R3, and R4.

Referring still to FIG. 3, the more protrusions that exist, the better the seal is between the protrusions P and inner pipe housing 32. However, given the same diameter, the more protrusions P that exist, the smaller the volume is that can be moved per rotation from an inlet volume to an outlet volume (for example, $VI_1$ to $VO_1$). Further examples of rotors useful according to other examples of the invention are seen in FIGS. 6A-6H, where a cylindrical void is not shown. There is no theoretical limit to the number of protrusions in various examples of the invention.

Referring again to FIG. 3, rotors R1, R2, R3, and R4 are shown solid for simplicity; however, in reality, the cylindrical void of each of the rotors includes a shaft and a bearing member 62, as also seen in FIG. 2. In the examples of FIGS. 2 and 3, bearing member 62 comprises a ball-bearing assembly (although other means for providing low friction rotation between a fixed shaft and a rotor also are useful in further examples of the invention). Still further, in other examples, rotors R do not spin around a shaft; rather, they are integrally formed with or connected in a fixed manner to the shaft, and the shaft spins on bearings mounted in the housing or an end plate. Further means of providing for rotational motion of rotors R will occur to those of skill in the art in view of the present disclosure that are within the scope of the present invention.

Even further, although the illustrated examples show rotors of substantially the same size, in alternative examples, a pair of rotors is of smaller diameter than another pair of rotors allowing for differences in the volume handled by the different inputs.

Figure 7:
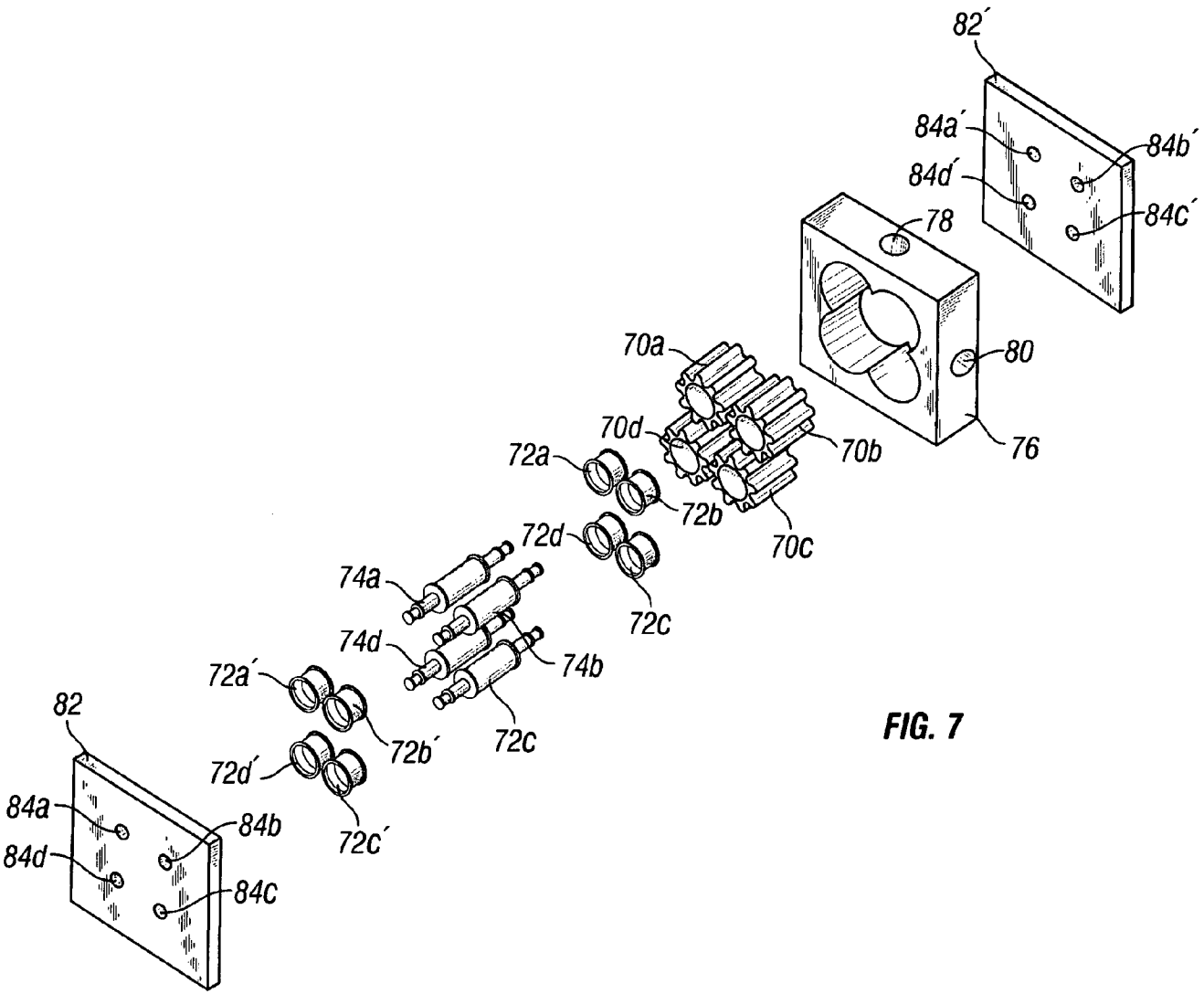
FIG. 7 is an exploded view of an example of the invention.

Referring now to FIG. 7, an example embodiment is seen in an exploded view in which shafts 74*a*-74*d* each have two bearings. For example, shaft 74*a* has bearing 72*a* and 72*a*'; shaft 74*b* has bearings 72*b* and 72*b*', etcetera. Rotors 70*a*-70*d* rotate on the bearings 72*a*-72*d* and 72*a*'-72*d*'. Shafts 74*a*-74*d* are fixed.

Rotors 70*a*-70*d* form inlet and outlet volumes in cooperation with each other and block 76 in which one inlet port 78 and one outlet port 80 are seen. The other inlet port is on the bottom of block 76 (not shown) and the other outlet port is on the fourth side of block 76 (also not shown). When assembled inside of block 76, shafts 74*a*-74*d* are mounted in end plates 82 and 82' through holes 84*a*-84*d* and 84*a'*-84*d'*.

In at least one example method of assembly, shims (not shown) are wrapped around rotors 70*a*-70*d* to set a consistent clearance between the block 76 and rotors 70*a*-70*d*. Dowel-pin holes (also not shown) are then drilled through end plates 82 and 82' and into block 76. The shims are then removed and the apparatus is re-assembled with the correct clearance, using the dowel-pin holes as a guide.

Figure 8:
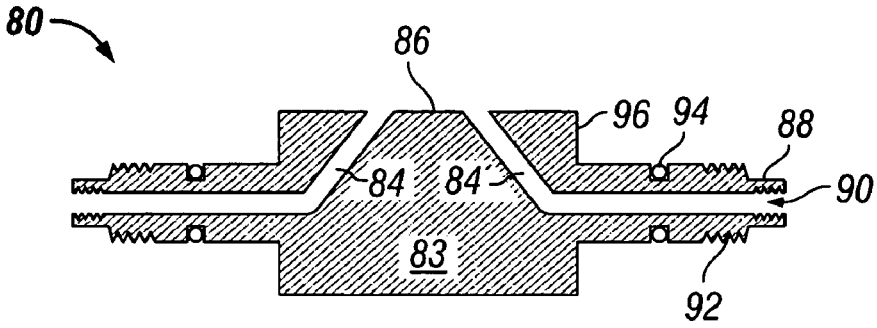
FIGS. 8-11 are sectional views of examples of the invention.

Referring now to FIG. 8, a sectional view of an example of a shaft useful in the example of FIGS. 2, 3, or 7 is seen. According to the example of FIG. 8, shaft 80 includes a shaft body 83 including a first oil path 84 and a second oil path 84'. Lubricated surface 86 of shaft 80 receives lubrication through oil paths 84 and/or 84' through an oil fitting 88, which includes oil port 90. Threads 92 allow shaft 82 to be connected in a fixed manner with a nut (not shown) outside of end plates 82 and 82' (FIG. 4). O-ring 94 is used to seal shaft 80 with end plates 82 and 82'; shoulder 96 butts up against end plates 82 and 82' providing an end-seal to prevent leakage of lubrication from lubricated surface 86.

Figure 9:
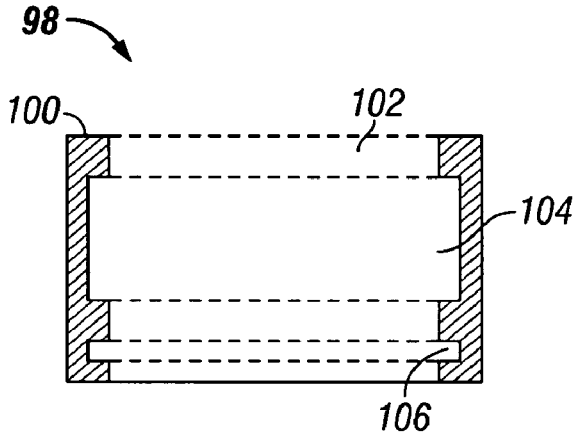

FIG. 9 shows a cross-section of an example of a babbit bearing housing 98 that is useful as a bearing in various examples of the invention. A substantially cylindrical body 100 includes a shaft hole 102. Within shaft hole 102, a babbit material cavity 104 is formed to receive babbit material, which is not shown in FIG. 9. Also included in shaft hole 102 is an O-ring seal groove 106.

Figure 10A:
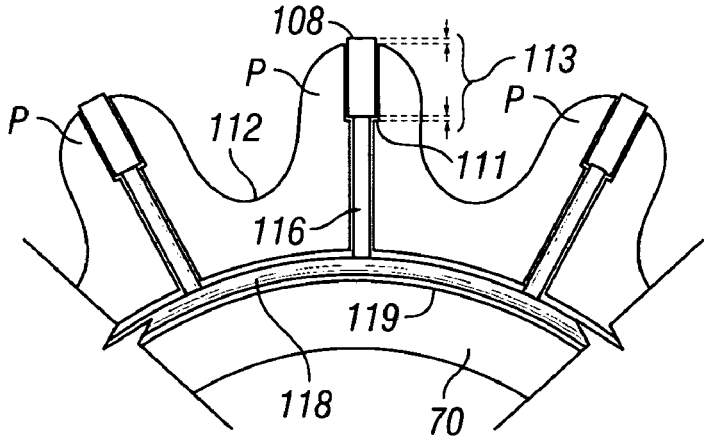
Figure 10B:
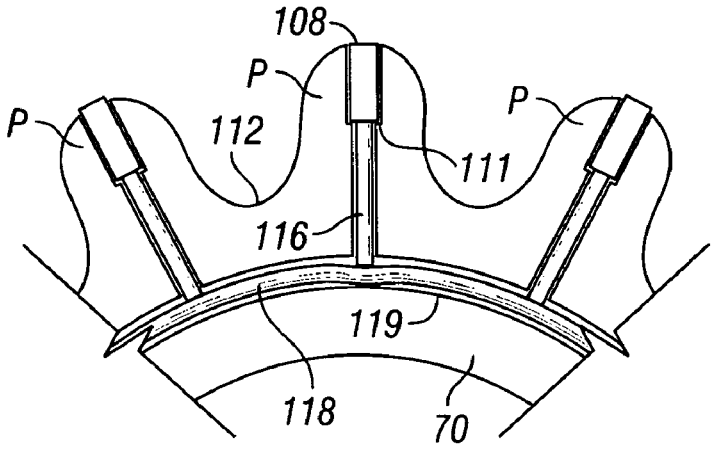

In some embodiments of the invention, the seal between rotors or between a rotor and the non-rotating housing or block is enhanced by a means for sealing (e.g., a seal member or blade) that extends from each protrusion. An acceptable example of such a means for sealing is seen in FIG. 10A, which is a cross-section of a rotor R having protrusions P, which include a longitudinal blade 108 and a pin 116. When a protrusion is not either mated in the recess 112 between two protrusions P of another rotor or engaged against the housing, blade 108 is in an extended position 113 from the bottom of channel 111 and is biased by an O-ring 118, which is held in a groove 119 of rotor 70. As seen in FIG. 10B, when a protrusion (here the middle protrusion) engages another rotor, blade 108 is compressed into protrusion P and pin 116 compresses O-ring 118, slightly. Blade 108 may still extend slightly from protrusion P, as discussed below. For simplicity, stop surfaces used to hold blade 108 in protrusion P are not shown but will occur to those of skill in the art. In some examples, blade 108 is flat, as seen; in further examples, the extended surface of blade 108 is curved.

Figure 11:
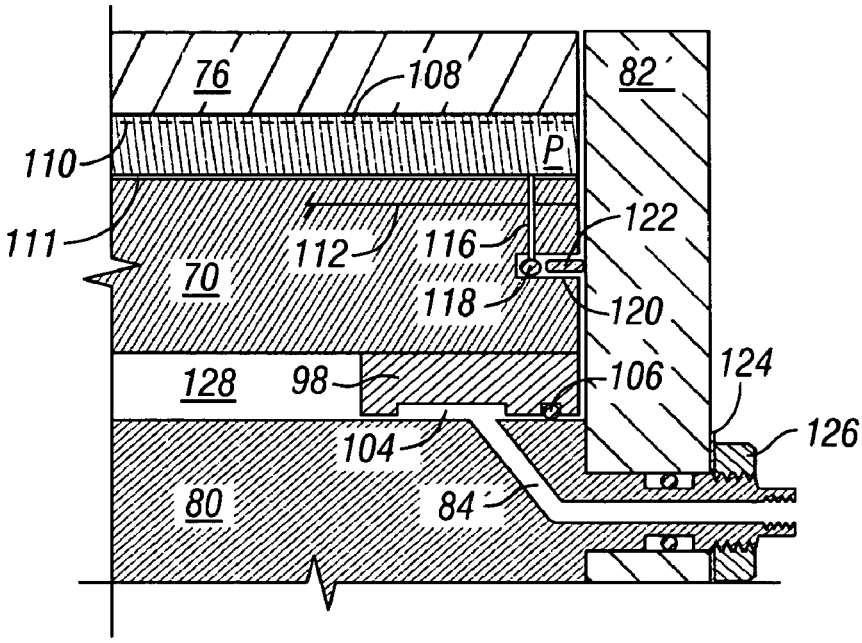

Referring now to FIG. 11, a cross-sectional view of an example assembled shaft bearing, and rotor, is seen. The top 110 of protrusion P of rotor 70 in the example shown is in a dashed line; blade 108 rides between the bottom of blade channel 111 in protrusion P and an extended position at the top-most travel of blade 108. As mentioned previously, blade 108 is positioned in a biased manner by pin 116 and a biasing means (for example, an O-ring) 118 that is held in a groove 120 and closed by an end seal 122. As briefly described earlier with reference to FIG. 8, a nut 126 backed by washer 124 fixes shaft 80 against end plate 82'.

During operation, as rotor 70 spins around bearings 98, and (as both bearings spin around shaft 80) a lubricant (e.g., oil) is supplied through lubrication paths 84 and 84' under babbit material (not shown) in cavity 104, lubricant moves between bearings 98 to substantially fill oil chamber 128 and to flow from shaft 84' to shaft 84 (or the reverse). The presence of a fluid in contact bearing 98 and/or rotor 70 also acts as a coolant of the member with which the coolant is in contact.

Referring still to FIG. 11, the top of blade 108 extends against the sidewall of block 76 (or, for example, inner pipe 32 of FIG. 3) to form a seal. There may be a very slight gap without blade 108, in some examples. In some examples that do not use a blade, the motion of the protrusion in close proximity to block 76 is believed to create a "labyrinth seal" or "sonic seal" due to turbulence. In some examples of the invention in which a labyrinth seal might not be relied on, blade 108 adds an additional seal. As rotor 70 turns to engage another rotor, blade 108 compresses within protrusion P. In further examples, neither a labyrinth seal nor a means for sealing (such as blade 108) is used.

Figure 12:
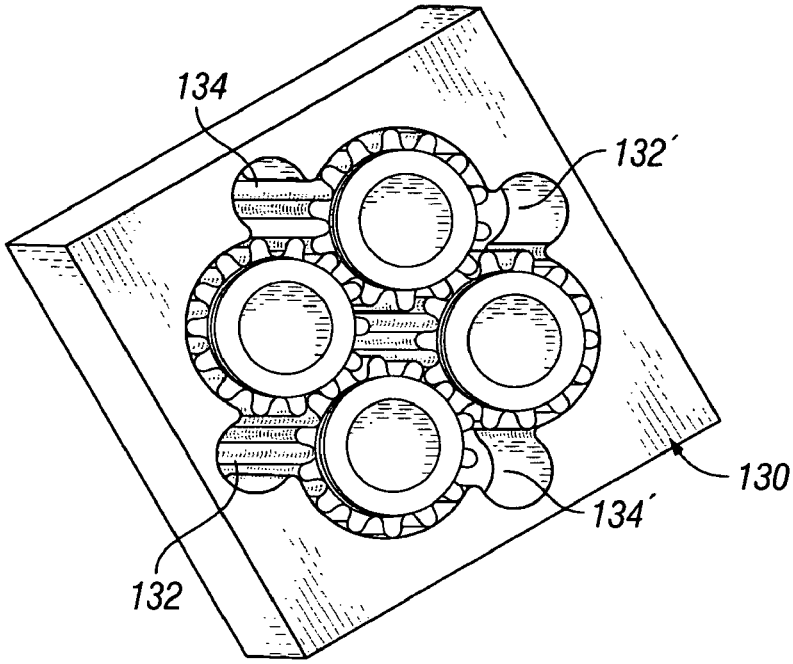
FIG. 12 is a perspective view of an example of the invention.

Referring now to FIG. 12, an alternative for block 76 of FIG. 7 is seen. Block 130 includes ports that are in parallel to the axes of rotation of the rotors. By contrast, in FIG. 7, block 76 is ported with inlet and outlet ports 78 and 80, which are normal to the axes of rotation of rotors 70*a*-70*d*. Specifically, in block 130 of FIG. 12, inlet ports 132 and 132' are provided opposite each other, and outlet ports 134 and 134' are also opposite each other. Such parallel porting reduces the potential for axial pressure differentials within any particular pressure volume.

Figure 13:
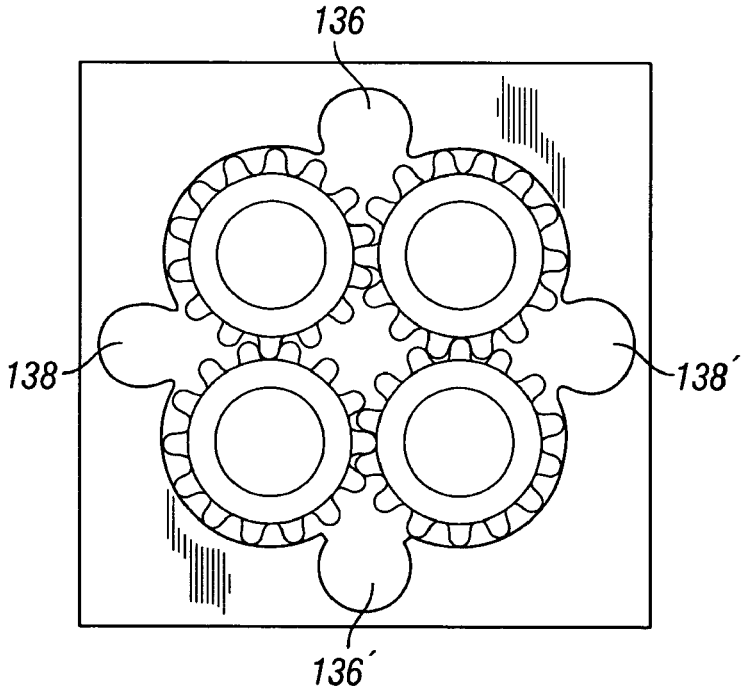
FIG. 13 is a sectional view of an example of the invention.

A cross-sectional view of block 130 is seen in FIG. 13 where it is seen that ports 136, 136' and 138, 138', respectively, are larger than in the example embodiment of FIG. 2 and FIG. 3. There, the circular configuration of the housing pipe 32 (which is in place of block 130 of FIG. 12 or block 76 of FIG. 7) defines smaller volumes. By adjustment of the length of the rotor, number of teeth, and diameter of the rotor, adjustment of the volume transferred per protrusion, matching of volumes, and varying pressure differentials between inputs is accommodated.

Figure 14:
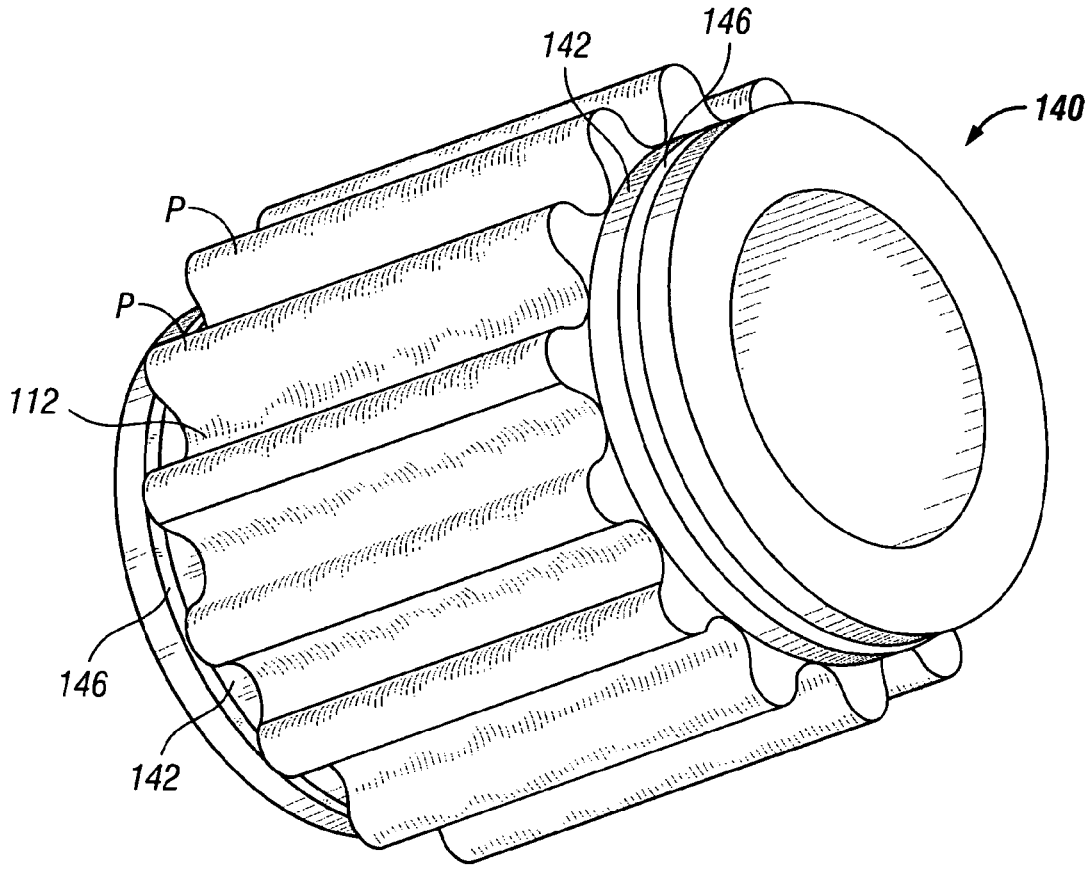
FIG. 14 is a perspective view of an example of the invention.

Referring to FIG. 14, an alternative rotor 140 is seen that includes protrusions P (as in earlier-described rotors) and that also includes a sealing surface 142 that is substantially flush with the bottom of the recess 112 between protrusions P. Such a sealing surface operating in conjunction with a seal in an end plate reduces the chance of the fluid, which becomes trapped between protrusions P, from leaking laterally around a protrusion. Groove 146 is cut in the sealing surface 142 to accept a means for sealing (for example, a ring seal of spring steel, an O-ring, etcetera) to further seal and prevent axial leakage.

Referring again to some examples similar to FIG. 3, once inner housing pipe 32 is assembled with rotors R1, R2, R3, and R4, a flange 33 is slipped over inner pipe housing 32 on both ends and welded to pipe 32. A raised face 35 of slip-on flange 33 is provided onto which O-ring seal channel 37 is formed. In place of the end plates 82 and 82' of the embodiment of FIG. 7, a blind flange (not shown) is mated with the slip-on flange 33 and secured with bolts 39 and nuts 39'. O-ring seal 37 mates with a complimentary raised face and O-ring groove on the blind flange (not shown).

Figure 15:
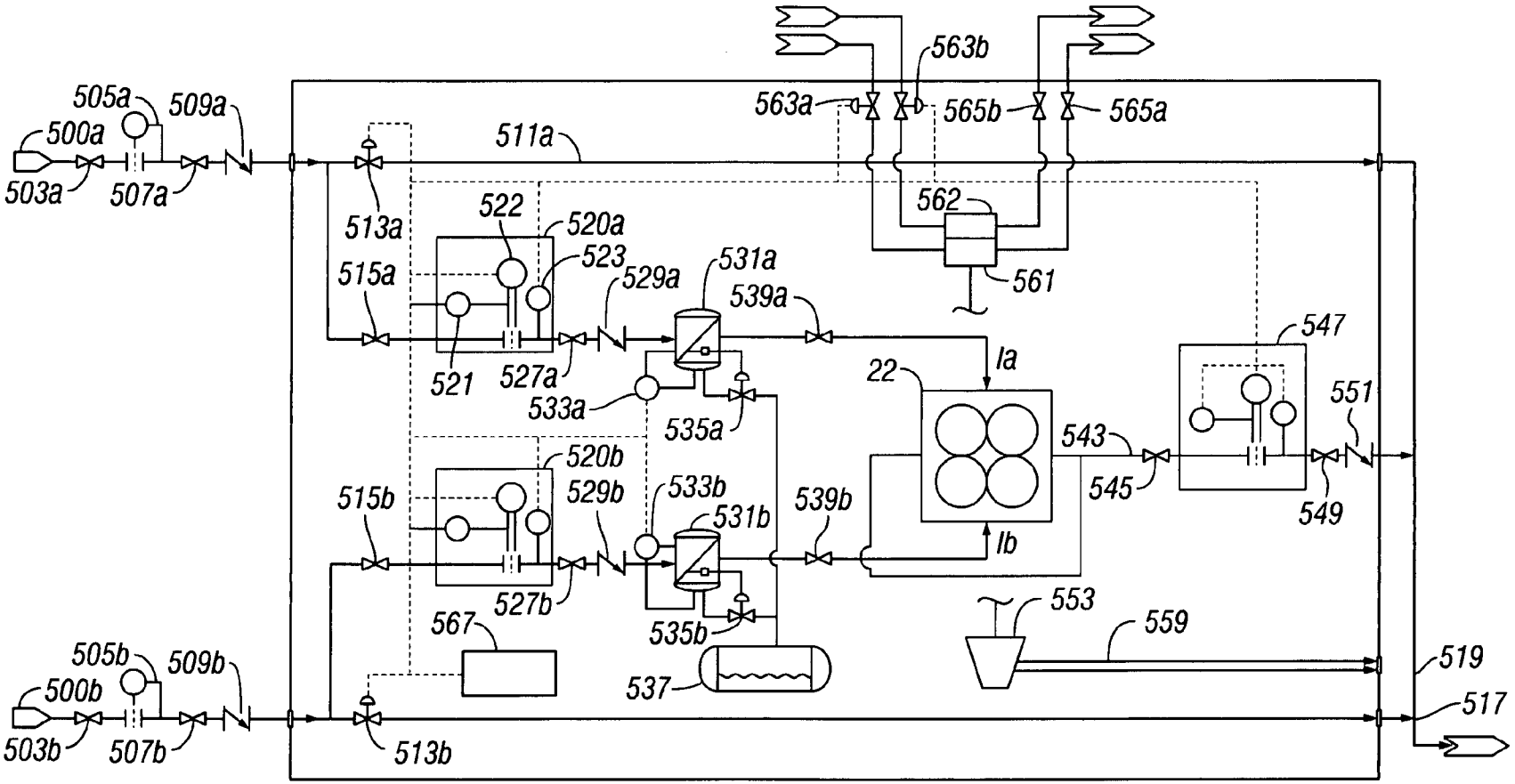
FIG. 15 is a schematic of an example of the invention.

Referring now to FIG. 15, still a further example of a merge unit system 26 is seen in which flow line inputs 500*a* and 500*b* connect through valves 503*a* and 503*b* and means 505*a* and 505*b* for measuring pressure (e.g., a differential pressure meter) and then through check valves 509*a* and 509*b*. Bypass lines 511*a* and 511*b* operate (when valves 513*a* and 513*b* are in an open state, and valves 515*a* and 515*b* are in a closed state) and are connected at a joint 517 in output flow line 519. When valves 513*a* and 513*b* are in a closed state, and valves 515*a* and 515*b* are in an open state, gas flows through measurement packages 520*a* and 520*b* (each comprising, in at least one example, a pressure measurement device 521, a differential pressure measurement device 522, and a temperature measurement device 523). Fluid then passes through valves 527*a* and 527*b*, through check valves 529*a* and 529*b* and into separators 531*a* and 531*b*, which are monitored by differential pressure measurement devices 533*a* and 533*b*, respectively. Float-actuated valves 535*a* and 535*b* operate to remove liquid from separators 531*a* and 531*b* and pass the liquid to tank 537.

Vapor from separators 531*a* and 531*b* passes through valves 539*a* and 539*b* into inputs Ia and Ib of combiner component 22, when valves 539*a* and 539*b* are in an open state. Combiner component 22 combines the pressures and fluid flows as discussed previously into output line 543 through valve 545 and measurement package 547. Fluid then flows through valves 549 and check valve 551 and into flow line 519. In such an operation, valves 513*a* and 513*b* are in a closed state.

In some embodiments, combiner component 22 has shafts that, rather than being fixed, rotate with the rotors. In at least one such embodiment, a shaft is used to turn an electrical generator 553, which produces power seen in output power lines 559. A rotational shaft of a rotor, in a further embodiment, is used to turn pumps 561 and 562 having input valves 563*a* and 563*b* and output valves 565*a* and 565*b*, respectively. Examples of inputs at valves 563*a* and 563*b* include liquids from oil or water at a well location to a central location, thus avoiding transport costs or for reinjection.

A control box 567 operates valves 563*a* and 563*b*, along with valves 513*a* and 513*b*, in response to measurements from measurement packages 520*a* and 520*b* and differential pressure measurement devices 533*a*, 533*b*, and 547. In some embodiments, solids filters similar to those shown in earlier figures are used.

The above description and the figures have been given by way of example only. Further embodiments of the invention will occur to those of skill in the art without departing from the spirit of the definition of the invention seen to the claims below.

What is claimed is:

1. An apparatus useful in combining at least two fluid streams of differing pressures, the apparatus comprising:

a housing;

a first rotor within the housing;

a second rotor within the housing, the first rotor engaging the second rotor and both the first and the second rotors engaging the housing;

a third rotor within the housing and engaging the first rotor;

a fourth rotor within the housing and engaging the second rotor, the third rotor engaging the fourth rotor and both the third and the fourth rotors engaging the housing;

wherein the first and the second rotors define a first input volume positioned and arranged to receive a first input stream having a first pressure;

wherein the third and the fourth rotors define a second input volume positioned and arranged to receive a second input stream having a second pressure;

wherein the first pressure differs from the second pressure;

wherein the first and the third rotors define a first output volume;

wherein the second and the fourth rotors define a second output volume; and wherein at least one rotor further comprises a means for sealing engagement, the means for sealing engagement comprising:

a set of protrusions;

a set of recesses between the protrusions;

wherein the protrusions comprise sealing surfaces;

wherein at least a portion of the protrusion sealing surface comprises a portion of a first circle;

wherein the recesses comprise sealing surfaces;

wherein at least a portion of the recess sealing surface comprises a portion of a second circle;

wherein the first circle and the second circle are tangential;

wherein the first circle and the second circle each have centers located on a circle having a center on an axis of the rotor.

2. An apparatus as in claim 1 wherein at least two rotors are in a sealing engagement.

3. An apparatus as in claim 1 wherein the rotors are substantially the same size.

4. An apparatus as in claim 1 wherein a first pair of the rotors is larger than a second pair of the rotors.

5. An apparatus as in claim 1 wherein the rotors are mounted on bearings around fixed shafts.

6. An apparatus as in claim 1 wherein at least one rotor is fixed to the shaft of the rotor.

7. An apparatus as in claim 1 wherein the housing comprises a substantially cylindrical shape having sealing surfaces arranged therein to seal with the rotors.

8. An apparatus as in claim 7 wherein the housing comprises inputs substantially normal to the axis of the housing.

9. An apparatus as in claim 7 wherein the housing comprises inputs substantially parallel to the axis of the housing.

10. An apparatus useful in combining at least two fluids of differing pressures, the apparatus comprising:

a housing;

a first rotor within the housing;

a second rotor within the housing, the first rotor engaging the second rotor and both the first and the second rotors engaging the housing;

a third rotor within the housing and engaging the first rotor;

a fourth rotor within the housing and engaging the second rotor, the third rotor engaging the fourth rotor and both the third and the fourth rotors engaging the housing;

wherein the first and the second rotors define a first input volume;

wherein the third and the fourth rotors define a second input volume;

wherein the first and the third rotors define a first output volume;

wherein the second and the fourth rotors define a second output volume; and wherein at least one rotor further comprises a means for sealing engagement, said means for sealing engagement comprising:

a set of protrusions; and a set of recesses between the protrusions;

wherein the protrusions comprise sealing surfaces;

wherein at least a portion of at least one sealing surface comprises a longitudinal blade disposed on at least one protrusion; and wherein said longitudinal blade is extendable from said at least one protrusion.

11. An apparatus as in claim 10 wherein at least two rotors are in a sealing engagement.

12. An apparatus as in claim 10 wherein the rotors are substantially the same size.

13. An apparatus as in claim 10 wherein a first pair of the rotors is larger than a second pair of the rotors.

14. An apparatus as in claim 10 wherein the rotors are mounted on bearings around fixed shafts.

15. An apparatus as in claim 10 wherein at least one rotor is fixed to the shaft of the rotor.

16. An apparatus as in claim 10 wherein the housing comprises a substantially cylindrical shape having sealing surfaces arranged therein to seal with the rotors.

17. An apparatus as in claim 16 wherein the housing comprises inputs substantially normal to the axis of the housing.

18. An apparatus as in claim 16 wherein the housing comprises inputs substantially parallel to the axis of the housing.

19. An apparatus as in claim 10 wherein at least a portion of the protrusion sealing surface comprises a portion of a first circle;

wherein at least a portion of the recess sealing surface comprises a portion of a second circle;

wherein the first circle and the second circle are tangential; and wherein the first circle and the second circle each have centers located on a circle having a center on an axis of the rotor.

* * * * *